United States Patent [19]

Morane et al.

[11] 3,964,643

[45] June 22, 1976

[54] UNPRESSURIZED CONTAINER FOR HOLDING A PLURALITY OF PRODUCTS SEPARATELY AND DISPENSING THEM SIMULTANEOUSLY

[75] Inventors: Bruno R. Morane; Jean-Louis H. Gueret, both of Paris, France

[73] Assignee: L'Oreal, Paris, France

[22] Filed: Dec. 23, 1974

[21] Appl. No.: 537,106

[30] Foreign Application Priority Data

Dec. 27, 1973 France ..... 73.46537
Dec. 3, 1974 France ..... 74.39496

[52] U.S. Cl. ..... 222/145; 206/219; 215/DIG. 8; 222/541

[51] Int. Cl.² ..... B65D 37/00

[58] Field of Search ..... 206/219; 128/218 M, 128/272; 215/6, DIG. 8; 222/80, 129, 130, 132, 145, 215, 541

[56] References Cited

UNITED STATES PATENTS

| | | | |
|---|---|---|---|
| 2,619,448 | 11/1952 | Larsen | 128/272 X |
| 2,783,091 | 2/1951 | Haldy | 222/189 |
| 2,808,184 | 10/1957 | Vanko | 222/189 X |
| 3,047,195 | 7/1962 | Richmond | 222/189 X |
| 3,576,987 | 5/1971 | Voight | 222/541 X |
| 3,584,211 | 6/1971 | Rauhut | 222/541 X |
| 3,813,534 | 5/1974 | Gillian | 206/219 X |

*Primary Examiner*—Stanley H. Tollberg
*Assistant Examiner*—David A. Scherbel
*Attorney, Agent, or Firm*—Brisebois & Kruger

[57] ABSTRACT

Unpressurized container for holding a plurality of products separately and dispensing them simultaneously comprises a deformable outer jacket, a rigid frangible tube so positioned within the outer jacket that it may be ruptured by flexing the outer jacket.

19 Claims, 11 Drawing Figures

UNPRESSURIZED CONTAINER FOR HOLDING A PLURALITY OF PRODUCTS SEPARATELY AND DISPENSING THEM SIMULTANEOUSLY

SUMMARY OF THE INVENTION

It is often necessary to make simultaneous use of several products which cannot be stored together for any substantial length of time. In this case it is necessary to utilize a container which permits the products to be isolated from each other during storage and then, after a predetermined action by the user, placed in contact with each other and mixed, with or without dissolution, just before being dispensed. Pressurized container of this type have already been devised, but it is the object of the present invention to provide unpressurized containers on which the user exercises force to cause mixture of the two products which are to be used simultaneously.

The present invention has as its object to provide a new article of manufacture which consists of an unpressurized container for storing separately and dispensing simultaneously at least two products, at least one which is liquid, said container comprising at least on dispensing orifice in its outer jacket and characterized by the fact that the closed outer jacket of the container is made of a flexible deformable material and said jacket contains at least one rigid closed frangible tube, said tube having a section smaller than that of the jacket and a central neck which is reduced in section, a first product to be dispensed being located inside each rigid frangible tube, and a second product to be dispensed being located inside the outer jacket of the container but outside the frangible tube or tubes.

In a first embodiment, the outer jacket of the container is elongated in shape, its length being greater than its maximum diameter, and said outer jacket is a cylinder which is substantially circular in section. This embodiment is perfectly satisfactory when the volume defined by the outer jacket of the container outside the frangible tubes is of the same order of magnitude as the volume defined by the frangible tube or tubes.

In a second embodiment the outer jacket of the container has at least two parts projecting inwardly, which parts are preferably more rigid than the other parts of the outer jacket. The neck of the frangible tube or tubes having a smaller section enclosed within the outer jacket is opposite the space which separates the two inwardly projecting portions of the outer jacket. The parts of the outer jacket which project toward the interior of the container are formed by bending the wall of the outer jacket of the container inwardly and are preferably two in number. The container has an oval section and the inwardly projecting portions are symmetrical with respect to the plane of symmetry of the container which passes through the major axis of the oval. In the wall of the container opposite the one which carries the inward projections and opposite the space which separates these projections there are protuberances also constituting projections directed toward the interior of the container. These protuberances are obtained by molding the container and are in the form of depressions in the outer jacket of the container. This embodiment is particularly satisfactory when a tube or tubes of relatively small volume are enclosed inside a relatively large container. It has been found that, in this case, the first embodiment may give rise to certain difficulties in use. In the first place, it may be difficult to break the frangible tube or tubes enclosed in the container if the outer jacket of the container is too far away from the wall of the tube, because, even with a deformable outer jacket, the force which may be exerted on the outer jacket to rupture the tube is often limited by the deformability of the jacket. In the second place, when the tube is broken, one of the parts of the broken tube may come into a transverse position between the two outer zones of the jacket which have been subjected to deformation to rupture the tubes and may then perforate the outer jacket of the container so as to render the device unusable. The second embodiment overcomes these defects in the case in which the container has a relatively large volume as compared with the volume of the tube or tubes.

In a preferred form of either of these two embodiments, each frangible tube is made of glass having a substantially constant thickness, preferably between 0.5 and 2 mm. The outer jacket has a neck to which a dispensing device is attached, a filter being interposed in the outward path of the mixture to be dispensed. The dispensing device is screwed onto the neck or snapped thereon using a ridge fitting into an associated groove, or may be crimped onto the neck of the container. The dispensing device is equipped with a tip adapted to be broken off. This opens an orifice through which the contents are dispensed. At the base of the neck of the jacket outside the container proper is a series of inner fins which prevent the broken tube or tubes from blocking the neck. The internal fins and the filter positioned in the neck are carried by the dispensing device associated therewith. The filter in the outlet path of the mixture being dispensed is a cloth of synthetic material such as the one sold under the trademark NYLON and adapted to prevent the passage of particles having average dimensions in excess of 50 microns.

It is a further object of the invention to provide a process of using the above-described container characterized by the fact that the user deforms the outer jacket by pressing it against the neck of the internal tube or tubes which is reduced in section so as to fracture these tubes. He then shakes the container, opens the dispensing orifice of the container, and thereby assures the simultaneous dispensing of the container contents through said orifice.

When this process is applied to the first embodiment of the invention, the user, in order to deform the outer jacket, grips each end of the jacket of the container in one hand with his thumbs pressing the central part of the jacket against the neck of the tube at the moment at which he bends the outer jacket of the container. In another variation of the process the outer jacket of the container carries a rigid sleeve in radial alignment with the neck of the frangible tube or tubes and the thumbs of the user press on the sleeve at the moment at which the outer jacket is flexed. In another variation there are two inner sleeves inside the rigid jacket surrounding the ends of the inner tube or tubes and the ends of the outer jacket are gripped in alignment with each of these rigid sleeves.

When the process defined above is applied to the second embodiment of the container according to the invention, the process may be carried out using only one hand, with the fingers of the user acting on a deformable wall of the outer jacket and the palm of the user acting on the opposite wall of said jacket so that the tube or tubes to be broken are forced against the internal projections of the jacket which are provided for this purpose. The force then exerted by the user is exerted on the outer jacket of the container in the wall zone opposite the wall zone which separates the internal projections and which is in alignment with the narrow neck of the frangible tube or tubes. This action by the user ruptures the tube or tubes which is caught between the two pressure points constituted by the projections and the point on which force is exerted by the fingers of the user. The break occurs in the zone between the internal projections, that is to say, in the zone in which the wall of the outer jacket of the container is remote from the broken section of the frangible tube or tubes. There is thus no risk that the broken ends of the tubes will perforate the outer jacket. This arrangement makes it possible to use containers having a relatively large volume as compared with the volume occupied by the frangible tube or tubes therewithin.

In another embodiment the tube or tubes to be broken is introduced into the container through the neck, which presumes that the outer diameter is less than the inner diameter of the neck. In another embodiment the tube or tubes to be broken are introduced into the container through an opening in the outer jacket thereof which is subsequently closed. This may be done, for example, by welding the two edges of the opened area after squeezing them together. Of course, in this embodiment, it is possible to insert frangible tubes which could not pass through the neck by introducing them through the opening in the outer jacket. It is also possible to introduce into the container one or more frangible tubes having a smaller diameter by introducing them through the neck of the container. When a frangible tube is introduced into the jacket through an opening provided for this purpose the product contained in the outer jacket externally of said tube is introduced into the jacket after the introduction of the tube and after closing of the opening provided in the outer jacket to admit the tube. The opening in the outer jacket may advantageously be provided in the bottom thereof.

It should be noted that each inner frangible tube of the container according to the invention has preferably a substantially constant wall thickness. When the tube is made of glass the neck of reduced section may be produced by hot knurling. It has been found that good results are obtained when using a glass tube having a wall thickness of between 0.5 and 2 mm, as above indicated. It should be noted that this embodiment of the frangible inner tube gives much more satisfactory results than when a frangible tube is used which has been scored so that the thickness of the wall is decreased in one zone because the operation of scoring a glass tube involves the use of tolerances such that one never knows the exact force which must be exerted on the tube to break it. It has also been found that the outer jacket should preferably be made of a polyethylene material having a wall thickness between 1 and 2 mm.

The filter member, which is preferably positioned in the outlet for the mixture to be dispensed, prevent the particles of glass resulting from the rupture of the internal tube or tubes from passing out of the container according to the invention at the same time as the product in the mixture to be dispensed.

When several frangible internal tubes are located inside a single outer jacket, it is obvious that more than two products may be stored separately therein and that these products may simultaneously be dispensed by first breaking all of the internal frangible tubes inside the jacket. Preferably the frangible internal tubes are of substantially the same length so that the deformation of the jacket will affect all of the tubes in the same way. In a useful variation of this embodiment the thickness of the walls of the various frangible inner tubes may be so selected that their resistance to breaking at their necks will be different. In this way, at the moment of use, when the user deforms the outer jacket of the container he first breaks the weakest internal tube, and then successively breaks the outer internal tubes in the order of their increasing resistance to breakage so that the user need only apply a relatively small force to break all the internal tubes, since these are broken successively over a period of time.

The container which has just been described may advantageously be used to obtain an aqueous solution of antibiotics, for example by introducing distilled water into the outer jacket and a penicillin powder into the frangible inner tube. It may also be used to permit the simultaneous use of a hair dye and its associated oxidizing agent. These two products are incompatible during storage. It may also be used to obtain a delayed action, for example the formation of a foam, a foaming cream or a warm cream, the calories being produced in the latter case by a heating reaction initiated just after the dispensing as a consequence of the mixture of the two products stored separately. The container according to the invention may also be used to dispense aqueous solution of unstable vitamins or to mix a polymerizable monomer with its polymerization accelerator. The latter case is particularly useful in the case of adhesives.

In order that the invention may be better understood, several embodiments thereof will now be described, purely by way of illustration and example, with reference to the accompanying drawings, in which.

Figure 1:
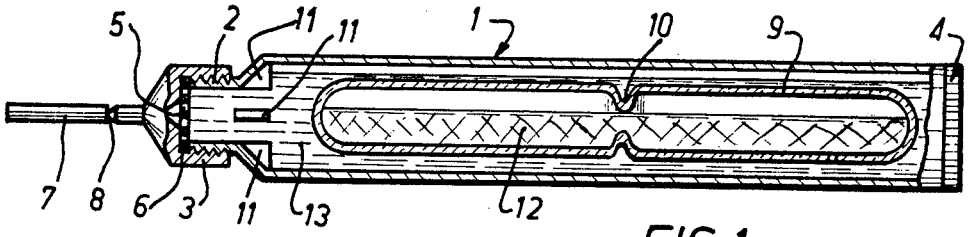
FIG. 1 is an axial sectional view taken through a container according to the invention holding a single rigid frangible tube.
Figure 3:
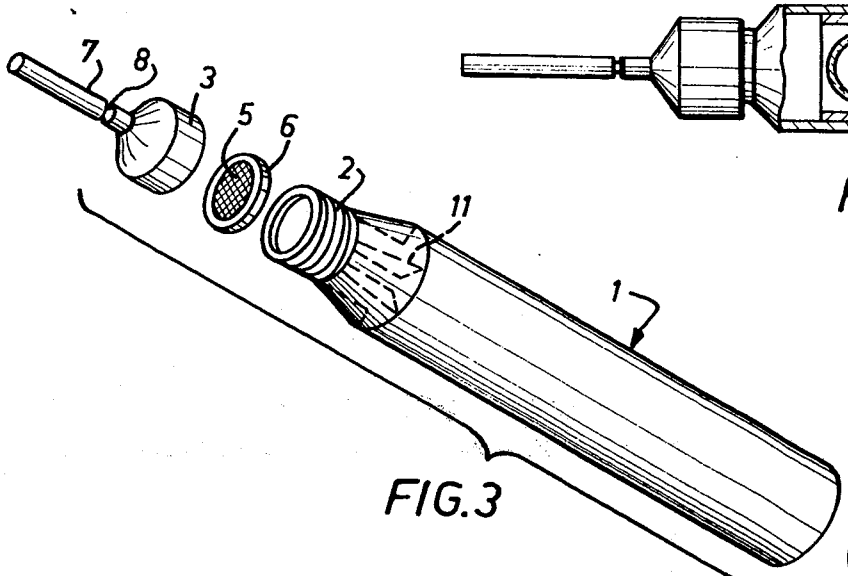
FIG. 3 is a perspective view of the components of the container of FIG. 1 before the two products to be stored therein have been introduced.

Referring now to the drawings, and more particularly to FIGS. 1 and 3, it will be seen that reference numeral 1 indicates the flexible outer jacket of a container according to the first embodiment of the invention. The jacket 1 is made of polyethylene having a thickness of about 2 mm, and is a cylindrical tube about 15 centimeters in length, and 3 centimeters in diameter. The outer jacket 1 has at one of its ends an externally threaded neck 2 which cooperates with an internally threaded dispensing device 3. It is closed at its other end by a welded seam 4. Gripped between the dispensing device 3 and the neck 2 is a filter 5 consisting of nylon cloth for arresting those particles having a diameter greater than about 50 microns. This nylon cloth is mounted in a circular peripheral frame 6 positioned between the neck 2 and the dispensing device 3. The dispensing device 3 is closed by a tip 7 which may be broken off by cracking a weakened zone 8, thus opening an orifice which permits the dispensing of the products contained in the outer jacket 1.

Inside the jacket 1 is a glass tube 9 having a substantially constant wall thickness of about 1 mm and an external diameter of about 15 mm. The tube 9 has a central neck which has been formed by hot knurling, the outer diameter of the tube in the zone 10 being about 10 mm. The tube 9 is located inside the jacket 1 and in order that it may not block the neck 2, radial fins 11 have been positioned in the zone of the neck and project toward the interior of the outer jacket 1.

A first product 12 is introduced into the tube 9, one end of which has been closed. Then the other end of the tube 9 is closed so as to isolate the product 12 inside the tube 9. The tube 9 is then introduced into the outer jacket 1 before the operation which results in the welded seam 4. The second product 13 is then introduced into the outer jacket and this jacket is closed by forming the welded seam 4.

Figure 2:
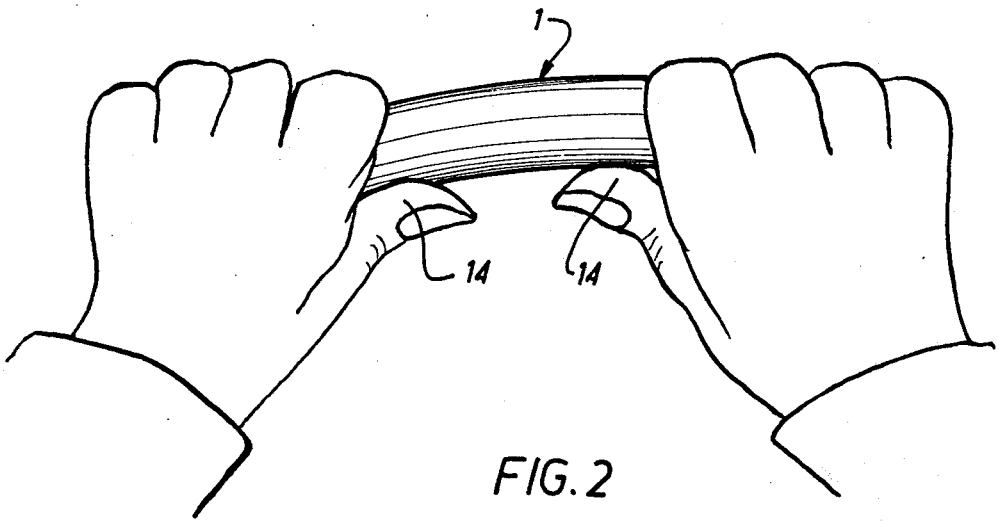
FIG. 2 is a perspective view showing how the user presses on the container of FIG. 1 to produce the mixture of the two products which have been separately stored therein.

In order to employ the container which has just been described, the user, as shown on FIG. 2, grips the outer jacket 1 at its two ends and exerts a bending movement by locating his thumbs 14 opposite the median zone, that is to say opposite the neck 10 of the tube 9. During this bending the user breaks the tube 9 at its neck 10, thus mixing the products 12 and 13. The user then breaks off the tip 7 at the zone 8 and lets the mixture of the products 12 and 13 flow out through the orifice thus formed in the dispensing device 3.

Figure 4:
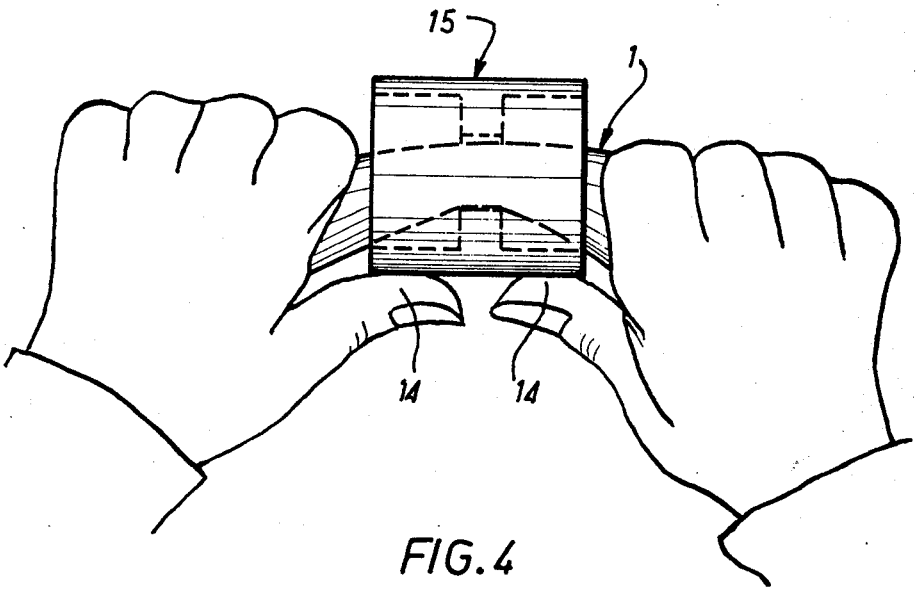
FIG. 4 shows a variation of the embodiment of FIG. 2 in which the user employs a rigid sleeve to break the frangible internal tube.
Figure 7:
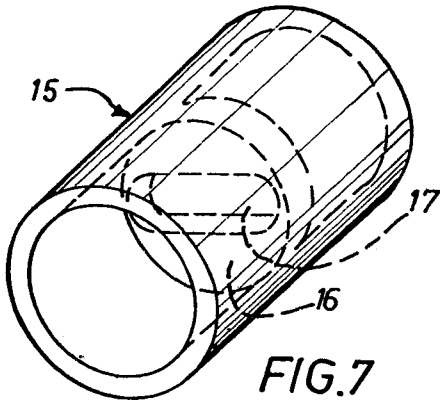
FIG. 7 is a perspective view of the sleeve of FIG. 4.

In the embodiment illustrated on FIG. 4, the thumbs 14 of the user do not act directly on the outer jacket of the container but act instead on a sleeve 15 which is first threaded onto the outer jacket 1 of container according to the invention. The sleeve 15 is shown in detail on FIG. 7. It comprises in its median zone a washer 16 provided with a oblong orifice 17 the length of which is slightly greater than the outer diameter of the outer jacket 1 and the width of which is slightly greater than the outer diameter of the tube 9 plus twice the thickness of the wall of the outer jacket 1. It is thus possible to insert the container according to the invention into the oblong opening 17 by deforming the external jacket and, under these conditions, the washer 16 grips the tube 9. At the moment at which the container is to be used the sleeve 15 is slid so as to bring the washer 16 to the middle of the outer jacket 1, that is to say, to the part within which the neck 10 of the tube 9 is located. The user then exerts on the jacket 1 a bending movement as indicated in FIG. 4, by placing his thumbs 14 against the sleeve 15, which permits him to exert pressure through the washer 16 on the neck 10 and thereby facilitate rupture of the tube 9.

Figure 6:
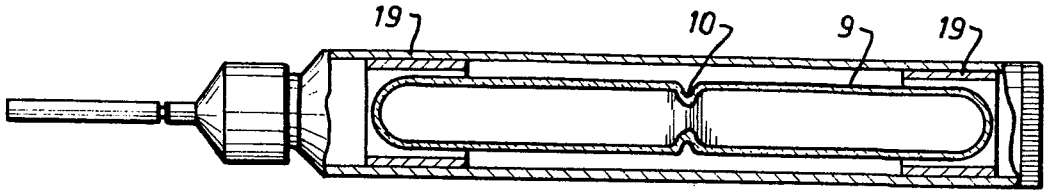
FIG. 6 is an axial sectional view showing another embodiment of the invention in which the outer jacket contains a rigid sleeve at each end.
Figure 5:
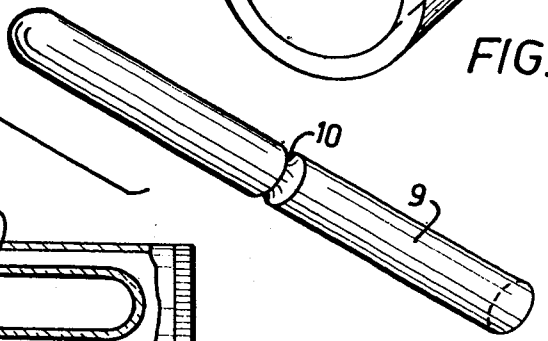
FIG. 5 is an axial sectional view showing a variation of the container of FIG. 1 in which the outer jacket contains a rigid internal sleeve.
Figure 5:
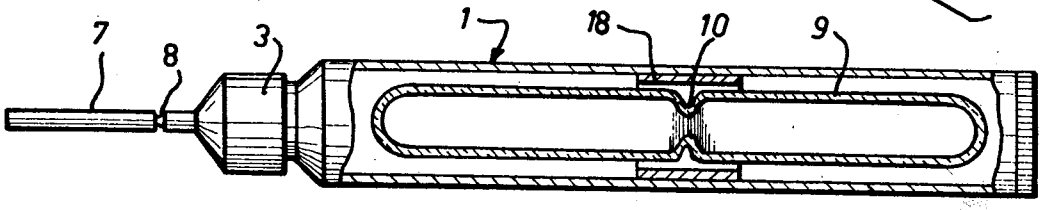

FIG. 5 shows a variation in which the outer tube 1 comprises internally, around the neck 10 of the tube 9, a rigid sleeve 18 defining a cylindrical ring. In the course of the bending operation designed to break the tube 9 the user, having taken the two ends of the container in his hands, presses with his thumbs on the zone around the sleeve 18, which facilitates the breaking of the tube 9 at its neck 10. In another embodiment illustrated on FIG. 6, sleeves 19, substantially identical to the sleeve 18 already described, are located inside the outer jacket 1 in alignment with the two ends of the tube 9. The sleeves 9 make it possible, at the moment at which the user wants to apply a bending force to the container, to hold the outer jacket 1 in his hands at the zone at which the outer jacket has sufficient rigidity to prevent the user from pressing directly on the tube 9. Bending movement by the user always breaks the tube 9 at its neck 10, while the sensation of holding it in the hand is ameliorated.

Figure 8:
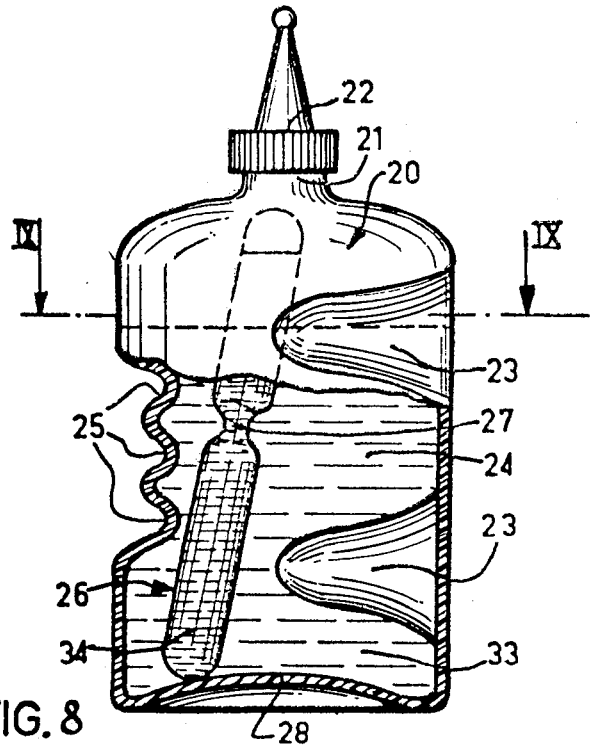
FIG. 8 shows a container according to the second embodiment of the invention, seen partially in elevation and partially in axial section, said container having a dispensing device and holding a single frangible tube.
Figure 9:
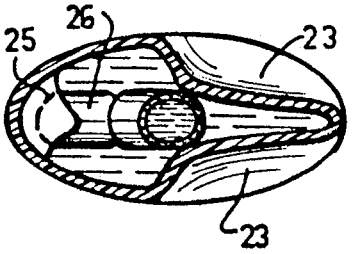
FIG. 9 is a sectional view taken along the line IX—IX of FIG. 8.
Figure 10:
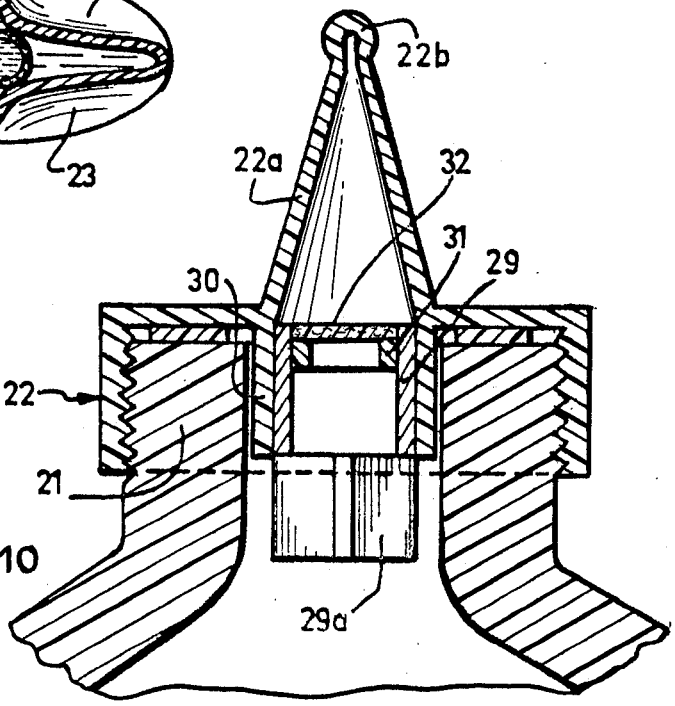
FIG. 10 is a detail view in axial section, taken through the neck of the dispenser of FIG. 8.

Referring now to FIGS. 8 to 10, it will be seen that reference numeral 20 indicates the container which constitutes the second embodiment of the invention. The container 20 has the general form of a cylinder with an elliptical base and comprises at its upper end a neck 21 associated with a dispensing spout 22. On opposite sides of the plane which divides the container 20 into two substantially equal parts and is perpendicular to the axis of said container, the container 20 has two gripping zones 23 in which the walls of the container are closer to each other. The outer jacket of the container 20 is made of polyethylene having a thickness of about 2 mm. The gripping zones 23 are formed when the container is molded. Between the two gripping zones 23 is a wider zone 24. The reduction in diameter which produces the two zones 23 is symmetrical with respect to a plane passing through the axis of the container 20 and the major axis of its elliptical section.

Opposite the zone 24 of the container 20 on the generatrix corresponding to the end of the major axis of the elliptical section which is opposite the one which is provided with the constricted zones 23, molded protuberances 25 have been provided in the form of depressions. The depressions 25 project toward the inside of the container 20 and are adapted to receive the fingers of the user of the container.

Inside the container 20 is a glass tube 26 having a substantially constant wall thickness equal to 1 mm. In its central zone the tube 26 has a neck 27, which has been formed by hot knurling. Tube 26 is introduced into the container through the neck 21. Its lower end rests on the bottom 28 of the container and its upper end bears against the uppermost zone 23 or against the projections 25. In order to prevent the tube 26 from blocking the neck 21 a member provided with fins 29 has been located inside the dispensing spout 22 which is screwed onto the neck 21. The member 29 comprises a cylindrical part which is force fitted in a sleeve 30 fixed to the spout 22 and, at the bottom of this cylindrical part, four fins in the form of a cross, indicated by reference numeral **29*a* on the drawing. In the center of the cylindrical part of the member 29 an annular ring 31 has been force fitted. This carries at its upper end a filter 32 consisting of a cloth made of a material such as nylon, which makes it possible to retain particles having average dimensions greater than 50 microns. The dispensing device 22 comprises a conical spout 22***a*, the end of which is provided with a tip 22*b*, which is adapted to be cut off.

When the user wants to employ the container 20 which has just been described, he holds the container in his hands by putting his fingers in the depressions 25 with the palm of his hand on the side of the constricted zones 23. The user then deforms the container by causing the depressions 25 to approach the projections formed by the constrictions 23. The constrictions 23 constitute abutments for the tube 26 because of the greater rigidity imparted thereto by the constriction of the material and the action of the user results in rupture of tube 26 at its neck 27. This causes the mixture of the liquid 23 contained in the outer jacket 20 and the liquid 34 contained in the tube 26.

The two parts of the tube which remain in the container 20 cannot, at the moment of breaking, tear the wall of the container because the break occurs within the space 24, that is to say in a place where the wall of the container is relatively far away from the tube. The mixture may then be dispensed by cutting off the tip 22*b* of the spout 22, the mixture being delivered through the filter 23 and the sections of the tube 26 being prevented from obstructing the neck by the fins 29*a*.

Figure 11:
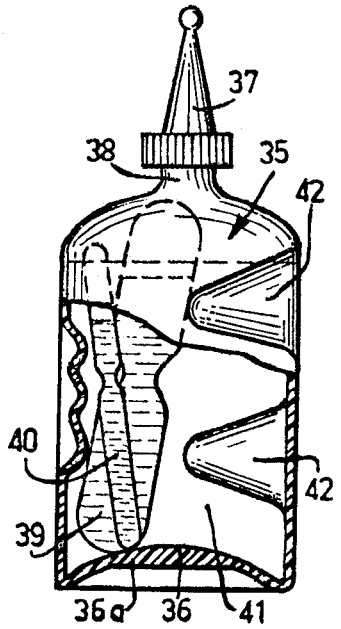
FIG. 11 shows another embodiment of the dispenser of FIG. 8 which contains two frangible tubes introduced through the bottom of the outer jacket.

It will be seen that the outer jacket according to the invention may have a substantial volume as compared with that of the tube 26 and that the tube 26 may nevertheless be broken without difficulty and without risk of perforating the wall of the outer jacket 20. In the embodiment shown in FIG. 11, the outer jacket is indicated by reference numeral 35. The jacket 35 has exactly the same shape as the jacket 20 previously described except that its bottom 36 is initially open. The spout 37 which is identical to the spout 22 is first mounted on the neck 38 which is identical to the neck 21. Two tubes 39 and 40 substantially identical to the tube 26 shown in FIG. 1 are then introduced into the jacket 35 through its open bottom 36. These tubes are made of glass and have a central neck. Each holds a different liquid product. The tube 40 has a small diameter whereas the tube 39 has an outer diameter larger than the inner diameter of the neck 38. The tubes 39 and 40 may be introduced without difficulty into the outer jacket through the open bottom 36, which is subsequently closed by squeezing the edges of the opening together and then welding them, a welded layer being indicated at 36*a* on the drawing. Alternatively, tube 39 may simply be introduced into the container 35 before sealing the bottom 36. When the outer jacket is closed the spout 37 is unscrewed and liquid 41 is then introduced into the outer jacket. If only the tube 39 has first been introduced into the outer jacket one may then also introduce the tube 40 through the neck 38. If, on the contrary, the tube 40 has been introduced into the outer jacket at the same time as the tube 39 through the open bottom 36 the filling of the outer jacket is completed once the liquid 41 has been introduced thereinto.

Force is exerted by the user on the outer jacket 35 in the same way as on the jacket 20 to break the tubes 39 and 40 at their necks. The presence of the two lateral constrictions 42 of the outer jacket 35 makes it possible to obtain the advantages which have already been described in connection with the embodiment of FIG. 8. It is also possible to make the tubes 39 and 40 of different thicknesses so that the rupture of these tubes takes place successively in time as the user exerts pressure on the outer jacket.

It will, of course, be appreciated that the embodiments which have just been described have been given purely by way of illustration and example and may be modified as to detail without thereby departing from the basic principles of the invention.

What is claimed is:

1. Unpressurized container for holding at least two products separately and distributing them simultaneously, at least one of said products being a liquid, said container comprising a rigid closed tube and an outer jacket surrounding said tube, said jacket being provided with at least one dispensing orifice and made at least in part of a deformable material, said tube having a section smaller than that of the jacket and a frangible central neck, one of the products to be dispensed being located inside said tube and another of said products inside said outer jacket but outside said tube, said outer jacket being provided with at least one relatively rigid portion positioned to exert a neck-fracturing pressure against said tube when brought into contact with said tube by deformation of said outer jacket.

2. Container as claimed in claim 1 in which the outer jacket of the container is elongated so that its length is greater than its maximum width.

3. Container as claimed in claim 1 in which each frangible tube is made of glass having a substantially constant thickness of between 0.5 and 2 mm.

4. Container as claimed in claim 1 in which the outer jacket comprises a neck carrying a dispensing spout, a filter being positioned in said neck.

5. Container as claimed in claim 4 in which the dispensing spout is screwed on to the neck.

6. Container as claimed in claim 4 in which the dispensing spout is provided with a frangible tip which, when broken off, opens an orifice through which the products may be dispensed.

7. Container as claimed in claim 4 in which the base of the neck of the outer jacket is provided with a group of internal fins preventing the frangible tubes from blocking the neck.

8. Container as claimed in claim 7 in which the internal fins and filter in the neck are carried by a spout associated with the neck.

9. Container as claimed in claim 4 in which the filter in the neck is made of a synthetic cloth which will pass only particles having average dimensions less than 50 microns.

10. Container as claimed in claim 4 in which at least one of the frangible tubes has an outer diameter greater than the inner diameter of the neck.

11. Container as claimed in claim 1 which holds a plurality of frangible inner tubes having different wall thicknesses, at least at their necks.

12. Container as claimed in claim 1 in which there is a single inner tube and the outer jacket contains a rigid internal sleeve surrounding the neck of said tube.

13. Container as claimed in claim 1 in which there is a single inner tube and two rigid inner sleeves carried by the wall of said jacket encircle the ends of the inner tube.

14. Unpressurized container for holding at least two products separately and distributing them simultaneously, at least one of said products being a liquid, said container comprising an outer jacket provided with at least one dispensing orifice, said outer jacket being made of a flexible deformable material and containing at least one rigid closed tube, said tube having a section smaller than that of the jacket and a frangible central neck, one of said products to be dispensed being located inside each rigid tube and another of said products being located inside said outer jacket but outside the tube, the wall of said outer jacket comprising spaced zones which project inwardly thereof, said zones having an increased rigidity as compared with the rigidity of the other parts of the outer jacket, the neck of sach tube within the jacket being located opposite the space separating two of said inwardly projecting zones.

15. Container as claimed in claim 14 in which the inwardly projecting zones of the outer jacket are produced by pressing the wall of the outer jacket inwardly and are two in number.

16. Container as claimed in claim 15 having an oval section, said inwardly pressed wall portions are symmetrically located with respect to the plane of symmetry of the container which passes through the major axis of the oval.

17. Container as claimed in claim 14 in which the wall of the outer jacket opposite that at which said zones project inwardly is provided with protuberances opposite the space between said inwardly projecting zones, said protuberances consisting of depressions extending toward the inside of said jacket.

18. Container as claimed in claim 17 in which the protuberances are obtained by molding by deformation of the outer jacket and are in the form of depressions.

19. Method of dispensing the contents of a container comprising a deformable outer jacket holding a rigid frangible inner tube having a weakened point, which method comprises the steps of sliding a rigid sleeve onto the outer jacket, bringing this sleeve into alignment with said weakened point, pressing with the thumbs against the sleeve while bending the outer jacket of the container and thereby exerting pressure on said weakened point to break said tube, and opening an orifice in the jacket so as to permit the simultaneous dispensing of the products stored therein.

* * * * *